US006837467B2

(12) United States Patent
Cheng

(10) Patent No.: US 6,837,467 B2
(45) Date of Patent: Jan. 4, 2005

(54) RECEIVING PLATE SUPPORTING DEVICE

(75) Inventor: Chen Kung Cheng, Taichung Hsien (TW)

(73) Assignee: E-Make Co., Ltd., Taichung Hsien (TW)

( * ) Notice: Subject to any disclaimer, the term of this patent is extended or adjusted under 35 U.S.C. 154(b) by 0 days.

(21) Appl. No.: 10/436,052

(22) Filed: May 13, 2003

(65) Prior Publication Data

US 2004/0124327 A1 Jul. 1, 2004

(30) Foreign Application Priority Data

Dec. 27, 2002 (TW) ..... 91221314 U

(51) Int. Cl.[7] ..... A47F 5/10

(52) U.S. Cl. ..... 248/240; 248/241; 108/108; 211/150

(58) Field of Search ..... 248/240, 240.4, 248/241, 243, 244, 286.1, 287.1, 284.1, 292.14; 211/144, 149, 150, 186, 187, 1.3, 90.01, 153, 90.02; 108/42, 47, 108

(56) References Cited

U.S. PATENT DOCUMENTS

| | | | | | |
|---|---|---|---|---|---|
| 1,200,477 | A | * | 10/1916 | Frantz | 16/348 |
| 1,777,886 | A | * | 10/1930 | Kusterle | 5/288 |
| 1,892,687 | A | * | 1/1933 | Otto | 211/99 |
| 2,210,762 | A | * | 8/1940 | Itzigson | 296/97.9 |
| 2,734,708 | A | * | 2/1956 | Cohn | 248/517 |
| 3,795,379 | A | * | 3/1974 | Gray | 248/242 |
| 4,460,145 | A | * | 7/1984 | Ando | 248/447 |
| 5,306,077 | A | * | 4/1994 | Trevaskis | 312/122 |
| 5,816,419 | A | * | 10/1998 | Lamson | 211/150 |
| 6,200,060 | B1 | * | 3/2001 | Vernay | 403/151 |
| 6,234,328 | B1 | * | 5/2001 | Mason | 211/90.02 |

FOREIGN PATENT DOCUMENTS

| | | | | |
|---|---|---|---|---|
| AU | 166684 | * | 1/1956 | 211/1.3 |
| GB | 455281 | * | 10/1936 | 211/149 |
| GB | 539722 | * | 9/1941 | |

* cited by examiner

*Primary Examiner*—Anita King
*Assistant Examiner*—Jon Szumny
(74) *Attorney, Agent, or Firm*—Troxell Law Office PLLC

(57) ABSTRACT

A receiving plate supporting device includes a base, two supporting portions, a movable plate and two sliding portions. The base has a pair of blocks which are spaced and installed at a wall. Each supporting portion is installed at each block having an upper slide path, a lower slide path and an outside slide path. The movable plate is a rectangular plate with a width corresponding to a distance between the two blocks. Each sliding portion is respectively corresponding to each supporting portion and is installed at the lateral side of the movable plate. Each sliding portion respectively passes through each supporting portion. The movable plate can be placed horizontally or vertically as desired. Therefore, it is space-efficient and convenient. Furthermore, the receiving plate supporting device can be assembled easily, and the structure of each component is easy and is cost-effective.

2 Claims, 7 Drawing Sheets

RECEIVING PLATE SUPPORTING DEVICE

FIELD OF THE INVENTION

The present invention relates to supporting structures, and particularly to a receiving plate supporting device.

BACKGROUND OF THE INVENTION

Due to the small lodging volume, each space in the room must be used efficiently. Therefore, receiving plates are commonly used in many places for receiving objects in a small space. However, often the receiving plate is not used and must be stored. Consequently, it has an eager demand for a novel receiving plate with can be expanded and folded as desired. All these objects can be complete by a well designed supporting structure.

The receiving plate supporting device of the prior art is illustrated in FIG. 1. The receiving plate supporting device mainly comprises a plate 90 for receiving objects and a supporting portion 91. The supporting portion 91 has two rods 911. One end of each rod 91 is pivotally connected to one end of another rod 91, and another ends are respectively pivotally connected to the plate 90 and a seat 92 pivotally connected to the plate 90. By bending the supporting portion 91, the plate 90 can swing so as to expand the plate 90 horizontally and store the plate 90 vertically.

However, the above prior art has a poor ability for bearing heavy objects. Since it is connected pivotally, when the two rods 911 suffer from an un-expect force or do not expand completely, the supporting portion 90 is easily to be bent so that the plate 90 will tilt. Thereby, the objects on the plate 90 will fall down. Moreover, when the prior art is assembled, two ends of the supporting portion 91 will be installed to the plate 90 and the seat 92 exactly, otherwise after the plate 90 is expanded, it can not be arranged horizontally completely and thus the effect for receiving objects are lost completely.

SUMMARY OF THE INVENTION

Accordingly, the primary object of the present invention is to provide a receiving plate supporting device, wherein a plate can be placed horizontally or vertically as desired. Therefore, it is space-efficient and convenient.

Another object of the present invention is to provide a receiving plate supporting device which can be assembled easily. The structure of each component is easy and is cost-effective.

To achieve the object, the present invention provides a receiving plate supporting device including a base, two supporting portions, a movable plate and two sliding portions. The base has a pair of blocks which are spaced and installed at a wall. Each supporting portion is installed at each block having an upper slide path, a lower slide path and an outside slide path. The movable plate is a rectangular plate with a width corresponding to a distance between the two blocks. Each sliding portion is corresponding to each supporting portion and is installed at the lateral side of the movable plate. The movable plate can be placed horizontally or vertically as desired. Therefore, it is space-efficient and convenient.

The various objects and advantages of the present invention will be more readily understood from the following detailed description when read in conjunction with the appended drawing.

DETAILED DESCRIPTION OF THE PREFERRED EMBODIMENTS

Figure 1:
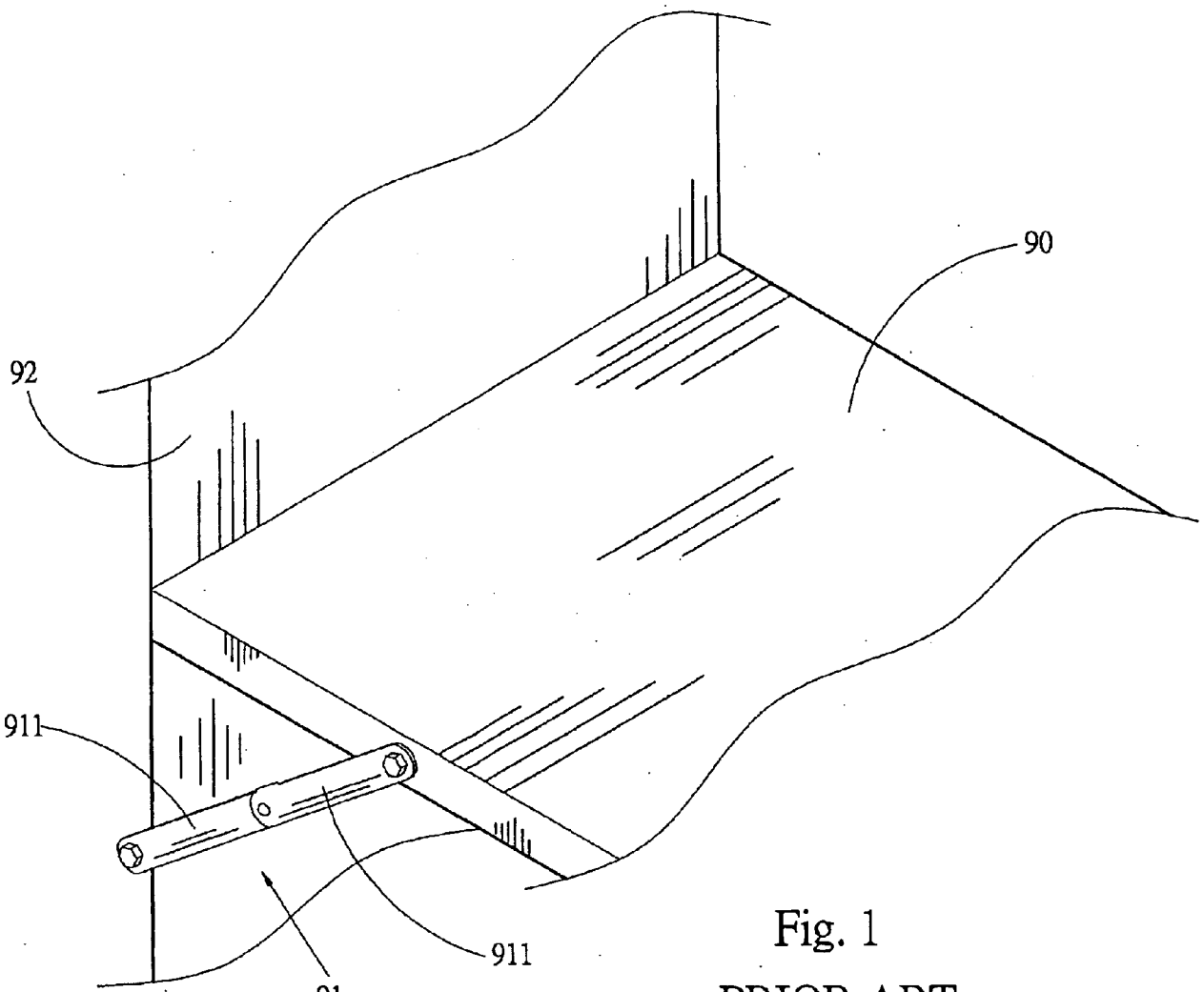
Fig. 1 PRIOR ART
FIG. 1 is a schematic perspective view of a prior receiving plate supporting device.
Figure 2:
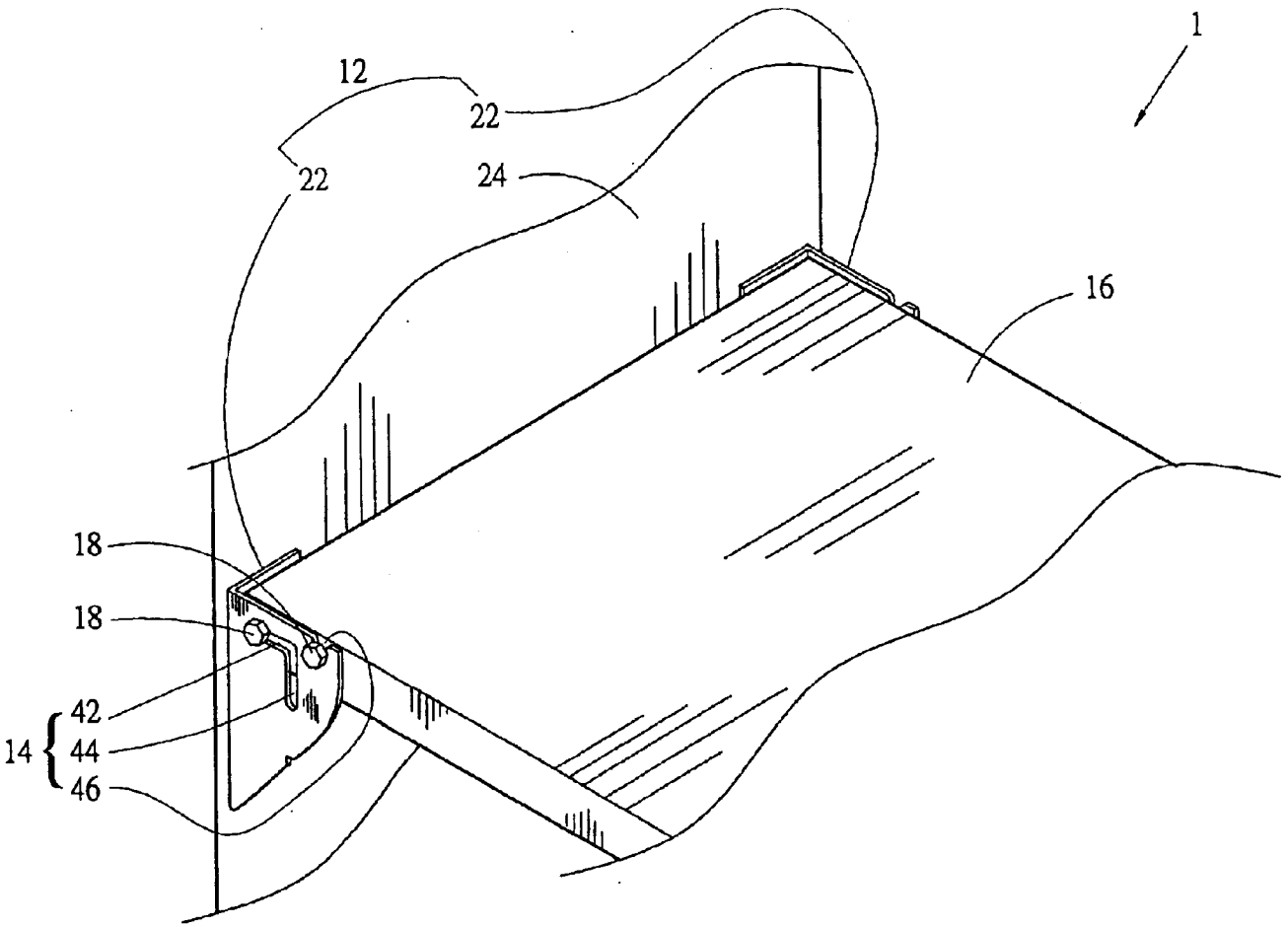
FIG. 2 is a schematic perspective view of the preferred embodiment of the present invention.
Figure 3:
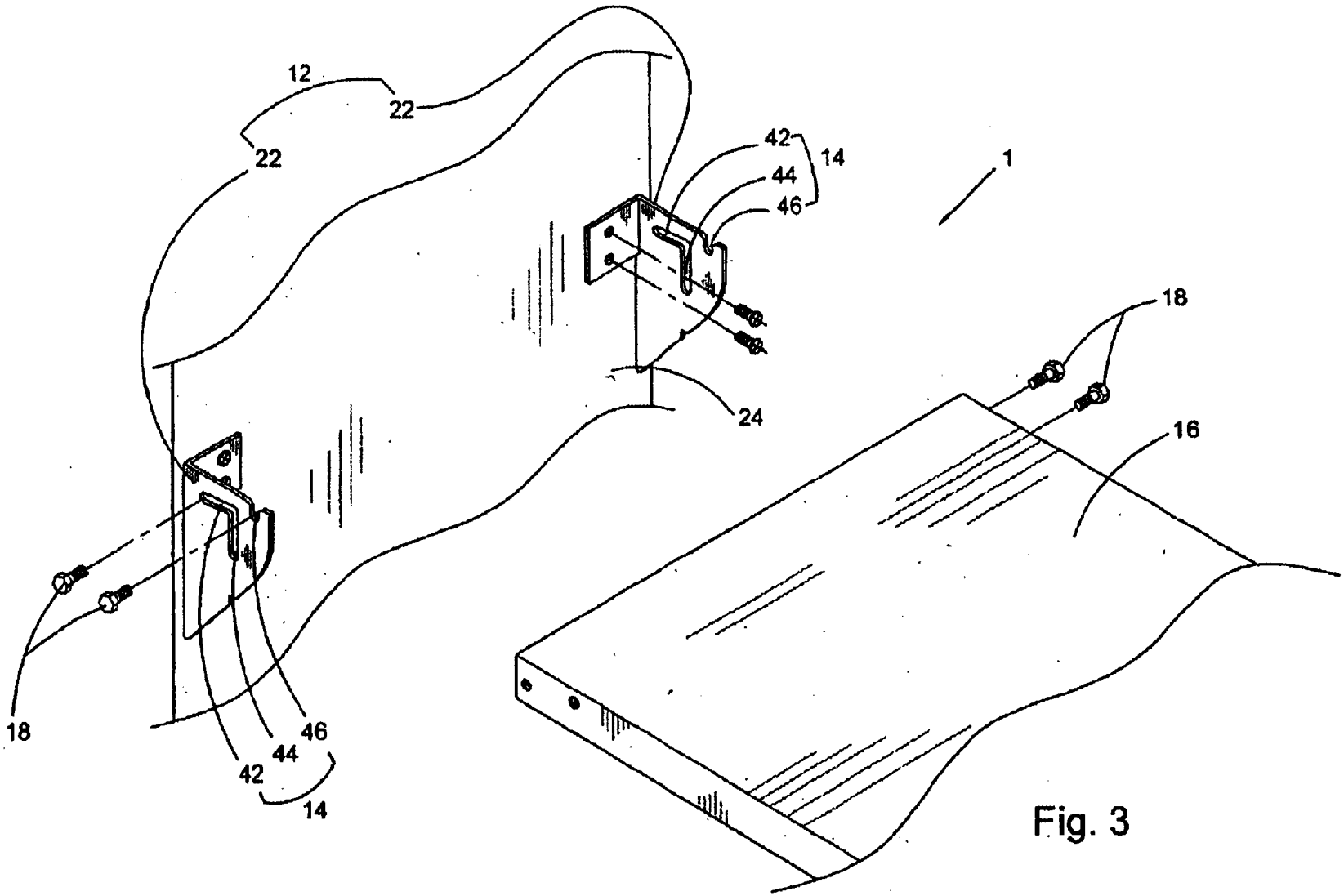
FIG. 3 is an exploded perspective view of the preferred embodiment of the present invention.

Referring to FIGS. 2 and 3, the receiving plate supporting device 1 of the present invention is illustrated. The receiving plate supporting device 1 includes a base 12, two supporting portions 14, a movable plate 16, and two sliding portions 18.

The base 12 includes a pair of blocks 22 which are spaced and installed at a wall 24.

Each supporting portion 14 is installed at each block 22. Each supporting portion 14 comprises an upper slide path 42, a lower slide path 44 and an outside slide path 46. The upper slide path 42 is a long hole which extends leftwards and rightwards with a length. The lower slide path 44 is a long hole which extends downwards from one end of the upper slide path 42 with a length. The outside slide path 46 is neighboring to the lower slide path 44. The outside slide path 46 is a long hole which extends downwards from the up lateral side of the block 22 with a length.

The movable plate 16 is a rectangular plate with a width corresponding to a distance between the two blocks 22.

Each sliding portion 18 like a rod is corresponding to each supporting portion 14 and is installed at the lateral side of the plate 16. Each sliding portion 18 respectively passes through each supporting portion 14 by the upper slide path 42, the lower slide path 44 and the outside slide path 46, wherein one of the sliding portions 18 slides between the upper slide path 42 and the lower slide path 44 and the other sliding portion 18 slides in and out the outside slide path 46. Thereby, the plate 16 may slide and swing by the two sliding portions 18 and the two supporting portions 14 and thus the plate 16 can be expanded and stored at any time.

Figure 4:
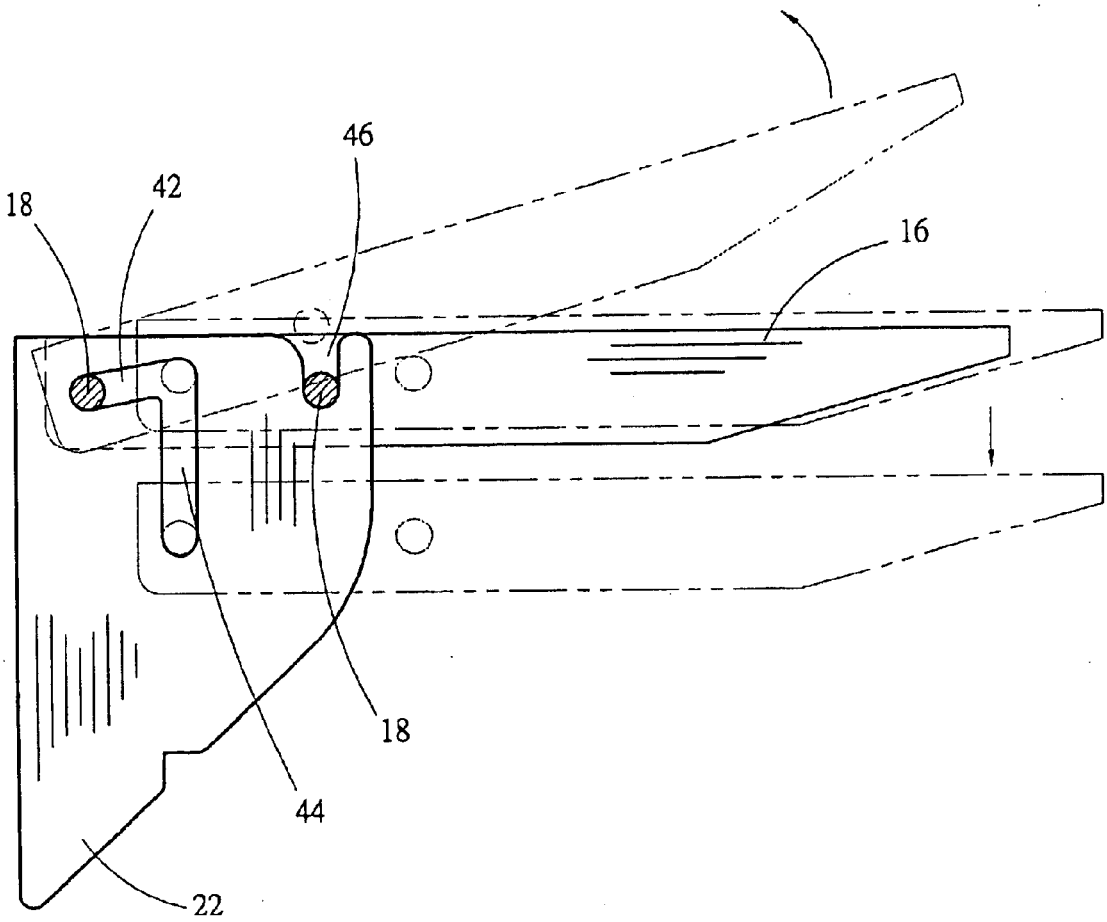
FIG. 4 is view showing the plate being stored in the preferred embodiment of the present invention.
Figure 5:
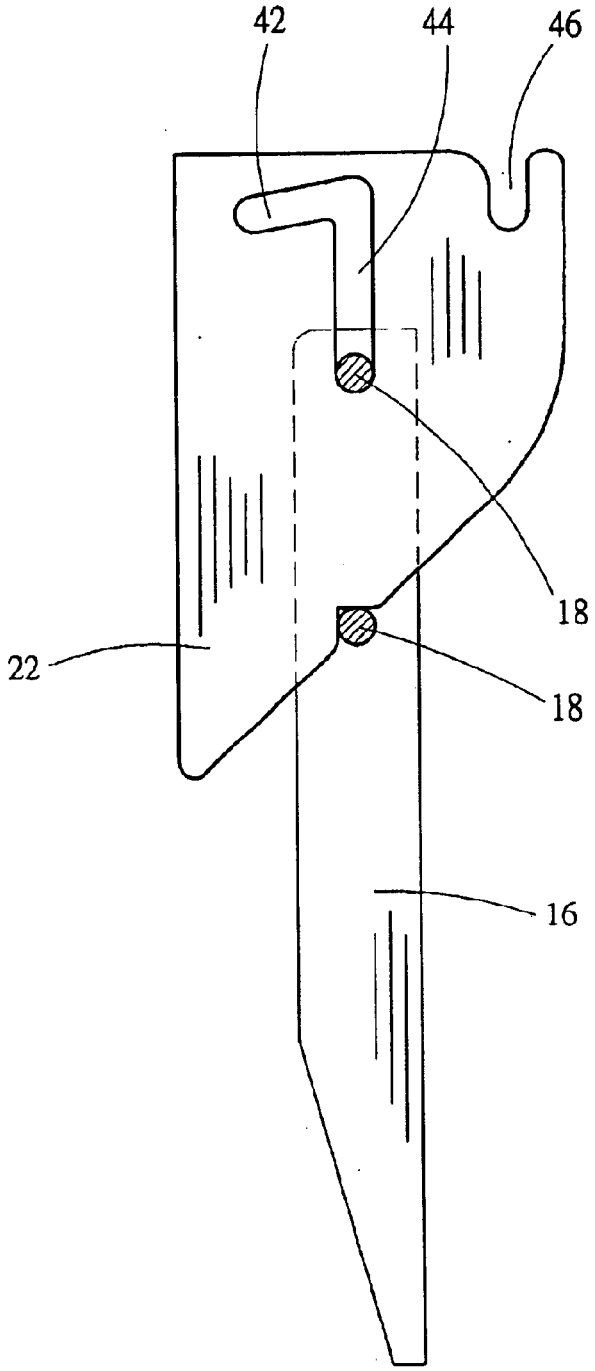
FIG. 5 is view showing a condition of the plate which is stored in the preferred embodiment of the present invention.

Referring to FIGS. 4 and 5, when the plate 16 is arranged horizontally and desired to store the plate 16. The plate 16 is rotated at first. One of the sliding portions 18 slides out the outside slide path 46. Then, the plate 16 is pulled. The other sliding portion 18 slides from the upper slide path 42 to the lower slide path 44. Then, the plate 16 is rotated. Thus, the plate 16 can be stored.

Figure 6:
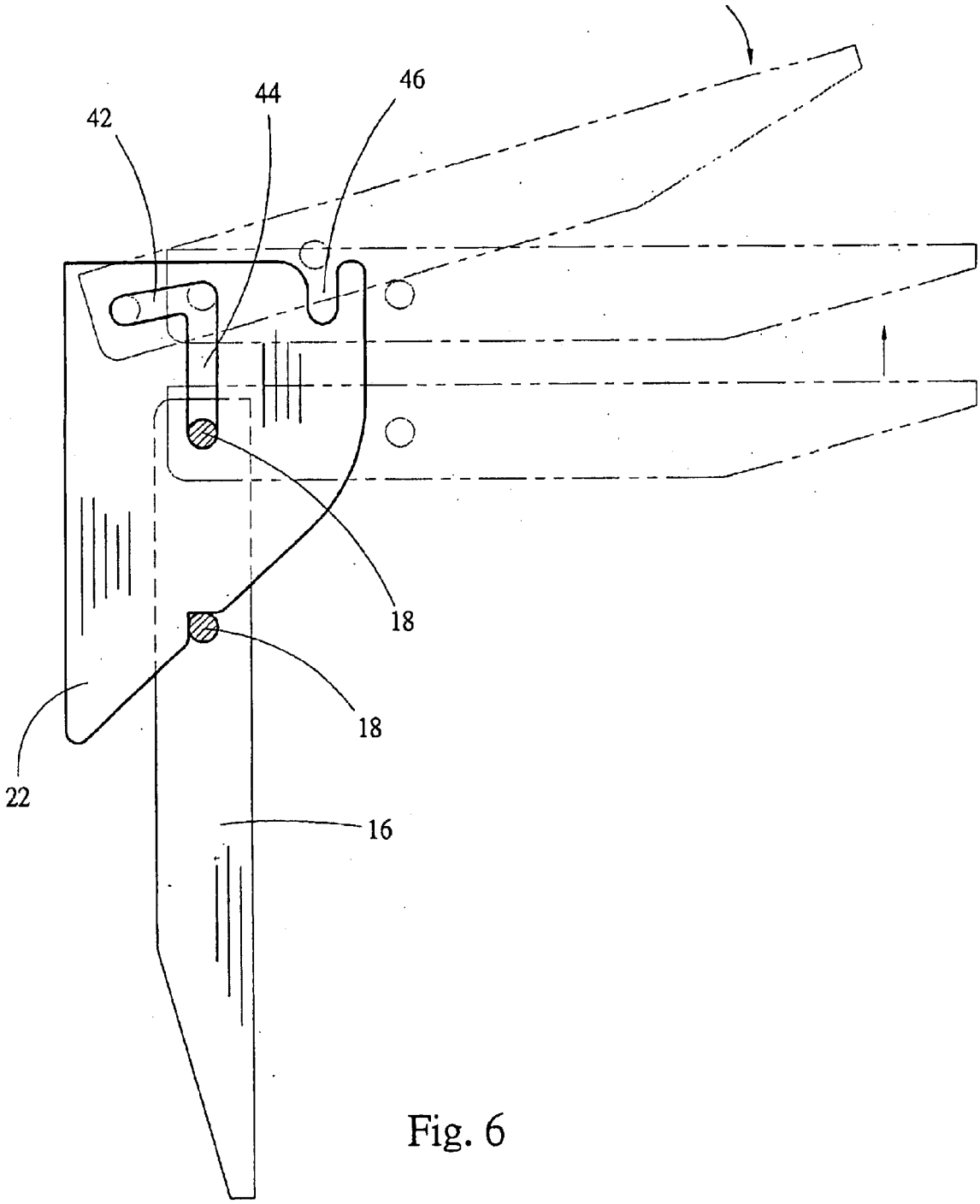
FIG. 6 is view showing the plate being lifted in the preferred embodiment of the present invention.
Figure 7:
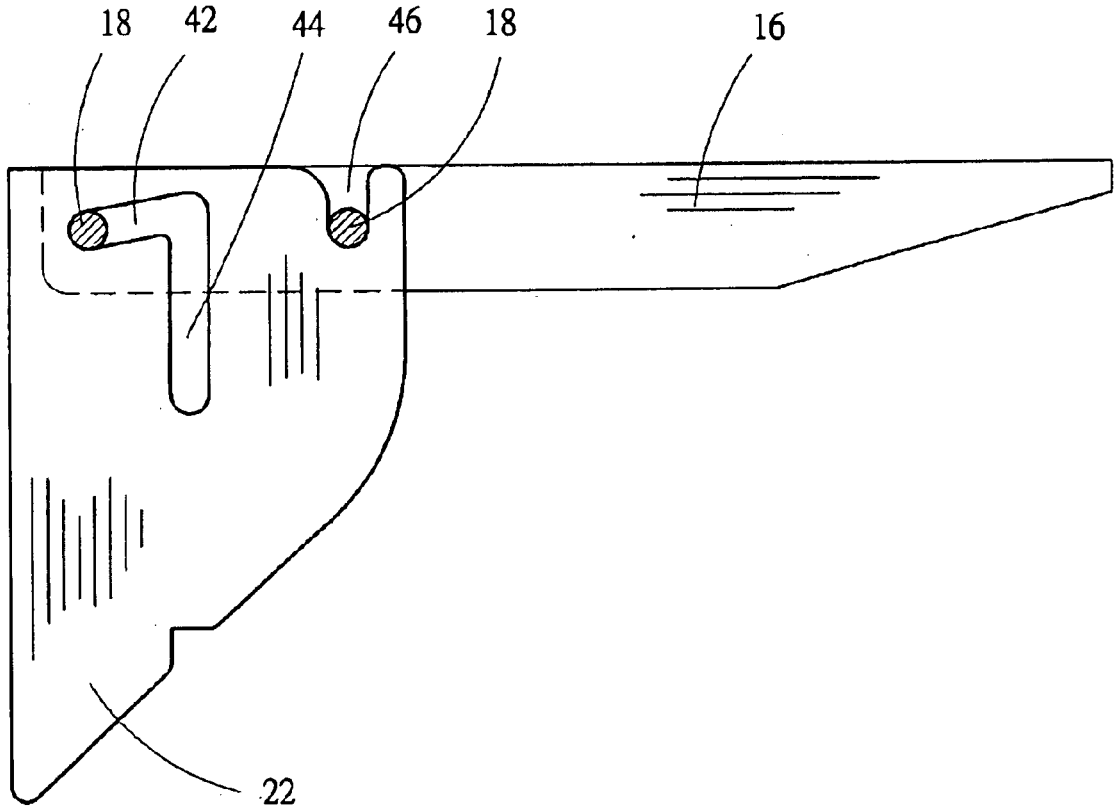
FIG. 7 is view showing a condition of the plate which is lifted in the preferred embodiment of the present invention.

Referring to FIGS. 6 and 7, when the plate 16 is arranged longitudinally. The plate 16 is rotated at first. Then, the plate 16 is moved upwards. One of the sliding portions 18 slides along the lower slide path 44 to an end of the upper slide path 42. Then, the plate 16 is pushed. The other sliding portion 18 is positioned at the outside of the outside slide path 46. Then, the plate 16 is rotated. Thus, the plate 16 can be expanded.

The receiving plate supporting device 1 of the present invention has the following advantages.

1. The plate 16 can be placed horizontally or vertically as desired. Therefore, it is space-efficient and convenient.
2. As one of the sliding portions 18 does not pass through each supporting portion 14 while the plate 16 is expanding or storing, the plate 16 has better free degree of space in changing its position. On the other hand, the plate 16 is moved under the condition of two points but not four points. It is very easy to rotate or move the plate 16.

3. The present invention can be assembled easily. The structure of each component is easy and is cost-effective.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. A receiving plate supporting device comprising:

a) a base having two spaced apart blocks, each of the two spaced apart blocks having:

i) an upper slot;

ii) a lower slot communicating with the upper slot; and iii) an outside slot extending inwardly from a top edge and communicating with an outer periphery thereof;

b) a rectangular plate having two opposing sides and being movable between horizontal and vertical positions; and c) two sets of sliding portions, each of the two sets of sliding portions extending outwardly from one of the two opposing sides of the rectangular plate, each of the two sets including a first sliding portion slidable between the upper and lower slots and a second sliding portion slidable between the outside slot and a exterior of one of the two spaced apart blocks, wherein, when the rectangular plate is located in the horizontal position, each first sliding portion is located in the upper slide portion and each second sliding portion is located in the outside slot, and when the rectangular plate is located in the vertical position, each first sliding portion is located in the lower slide portion and each second sliding portion is located on the outer periphery of one of the two blocks.

2. The receiving plate supporting device according to claim 1, wherein each first and second sliding portion of the two sets of sliding portions is a rod.

* * * * *